US005134918A

United States Patent [19]

Chang

[11] Patent Number: 5,134,918

[45] Date of Patent: Aug. 4, 1992

[54] PENCIL BOX WITH KEYBOARD INSTRUMENT AND COMPARTMENT AUTOMATIC OPEN CONTROL

[76] Inventor: Yun-Chih Chang, No. 44, Alley 32, Lane 56, Wo Lung Street, Taipei, Taiwan

[21] Appl. No.: 791,514

[22] Filed: Nov. 14, 1991

[51] Int. Cl.[5] ..... G10H 1/34

[52] U.S. Cl. ..... 84/600; 84/95.2; 206/214; 206/371; 206/557; D3/30.1

[58] Field of Search ..... 84/600, 644, 670, 718-721, 84/743-746, 94.1, 94.2, 95.1, 95.2, DIG. 3, DIG. 17; 206/214, 371, 557-567; 220/504; D3/30.1-79

[56] References Cited

U.S. PATENT DOCUMENTS 4,882,966 11/1989 Silverman ..... 84/94.2

*Primary Examiner*—Stanley J. Witkowski

*Attorney, Agent, or Firm*—Fleit, Jacobson, Cohn, Price, Holman & Stern

[57] ABSTRACT

A pencil box made in the shape of a mobile telephone, comprising an upper shell separated from a bottom shell by a transverse partition board, a big sliding box at one side below said partition board for holding pencils, two small sliding boxes at one end above said partition board, a small sliding box and a sliding pencil holder at an opposite end above said partition board, a movable pencil sharpener in said upper shell at the top, a music IC on said partition board controlled to produce sounds by music playing keys on said upper shell, a brake control assembly on said partition board to retain said sliding boxes and said sliding pencil holder and said pencil sharpener in place, spring means controlled by control keys on said upper shell to automatically respectively push said sliding boxes, said sliding pencil holder and said pencil sharpener out of said upper or bottom shell.

2 Claims, 3 Drawing Sheets

PENCIL BOX WITH KEYBOARD INSTRUMENT AND COMPARTMENT AUTOMATIC OPEN CONTROL

BACKGROUND OF THE INVENTION

The present invention relates to pencil boxes and relates more particularly to a pencil box having music playing keys for controlling a music IC to produce different sounds, and control keys for controlling a plurality of brake members to release a plurality of sliding boxes, a pencil sharpener and a pencil holder respectively.

Conventionally, a pencil box is simply a box comprised of a cover covered on a casing with a holding space defined therein for holding pencils and small writing materials. This simple structure of pencil box has no longer any attraction for the child of the modern time. Every pencil box manufacturer has been trying to diversify its production so as to attract children to buy. It has been the common way to make a pencil box more attractive by making more compartments in a pencil box, attaching small tools to a pencil box, or designing an attractive formation for a pencil box.

SUMMARY OF THE INVENTION

The present invention has been accomplished under the circumstances in view. It is therefore an object of the present invention to provide a pencil box which is made in an attractive design and practical in use for keeping pencils and small writing materials. It is another object of the present invention to provide a pencil box which can be used as a toy music instrument for amusement. It is still another object of the present invention to provide a pencil box which has means to automatically push out the sliding boxes therein for arrangement.

According to the present invention, there is provided a pencil box made in the shape of a mobile telephone, which has a music IC fastened therein and controlled by a keyboard to produce different sounds, a brake control assembly to hold a plurality of sliding boxes, a sliding pencil holder and a pencil sharpener in place, a plurality of control keys to release said sliding boxes, said sliding pencil holder and said pencil sharpener from said brake control assembly, and a plurality of spring means to automatically respectively push said sliding boxes, said sliding pencil holder and said pencil sharpener out of the pencil box for arrangement by means of the control of said control keys.

DETAILED DESCRIPTION OF THE PREFERRED EMBODIMENT

Figure 1:
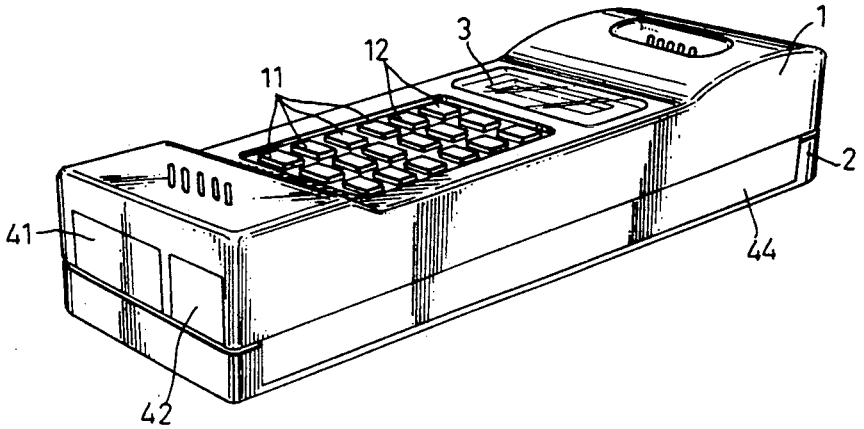
FIG. 1 is a perspective assembly view of the preferred embodiment of the pencil box of the present invention.
Figure 2:
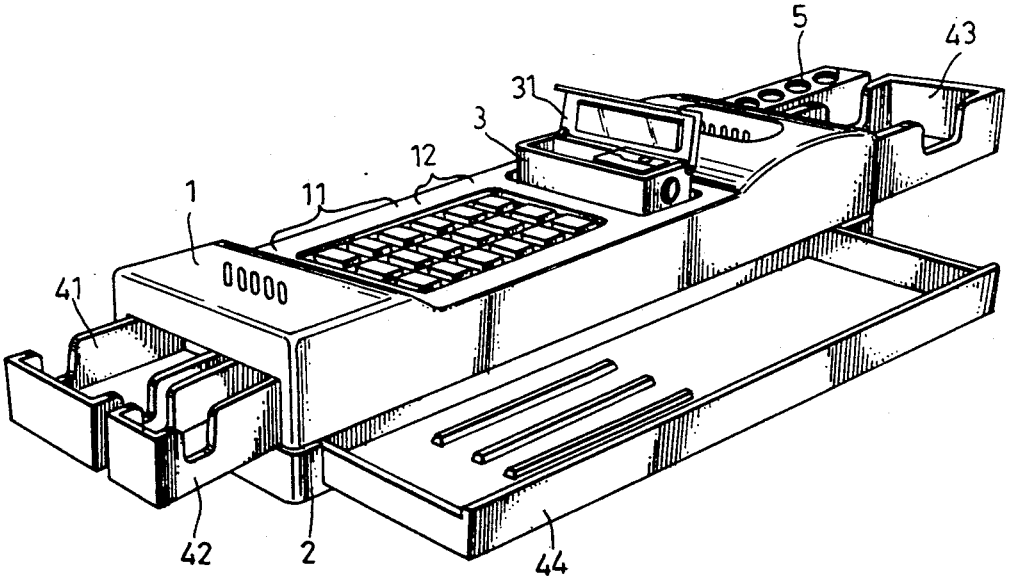
FIG. 2 is an expanded perspective view thereof.

Referring to FIGS. 1 and 2, a pencil box is comprised of an upper shell 1 and a bottom shell 2 and made in shape like a mobile telephone. The upper shell 1 has twelve music playing keys 11 and six control keys 12 at the middle, a movable pencil sharpener 3 adjacent to the control keys 12 at one side, a lid 31 above the pencil sharpener 3, two sliding boxes 41, 42 at one end, another sliding box 43 and a sliding pencil holder 5 at an opposite end, and a big sliding box 44 at one side for holding pencils. The sliding pencil holder 5 resembles the antenna of a mobile telephone when it is extended out of the upper and bottom shells 1, 2.

Figure 3:
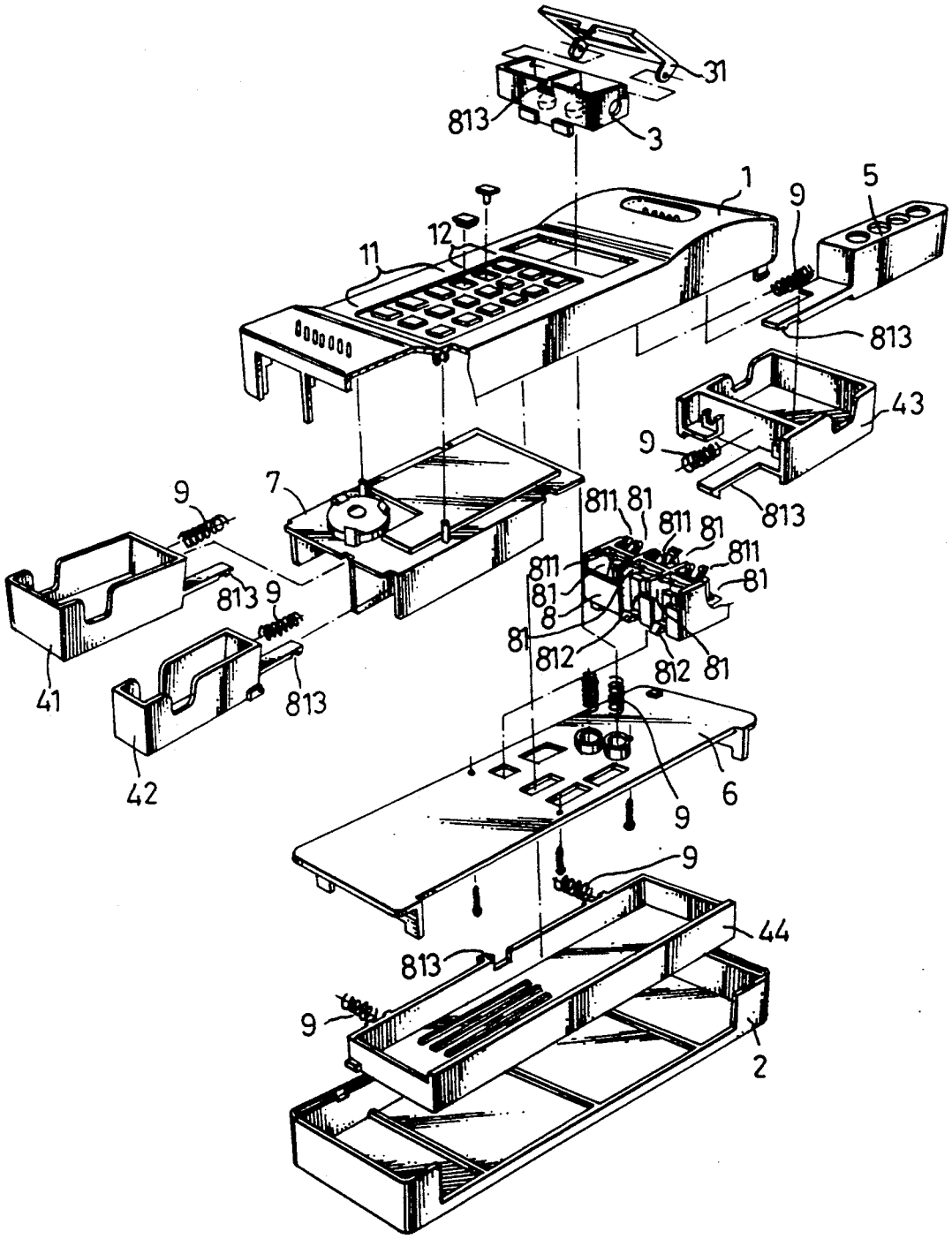
FIG. 3 is an exploded perspective view thereof.
Figure 4:
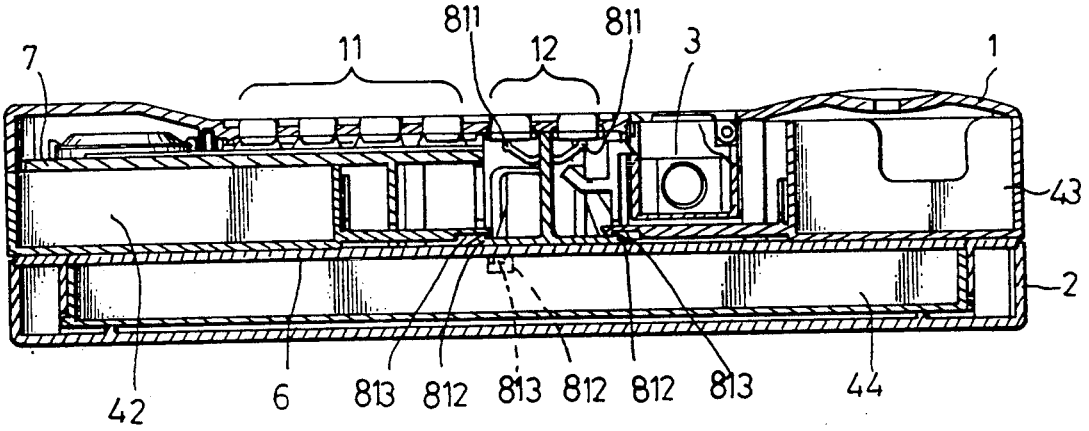
FIG. 4 is a cross section taken in longitudinal direction showing the operation of the brake control assembly in controlling a sliding box.

Referring to FIG. 3, a partition board 6 is fastened in between the upper and bottom shells 1, 2 to divide the holding space of the pencil box into an upper chamber and a bottom chamber. The big sliding box 44 is fastened in the bottom chamber between the bottom shell 2 and the partition board 6. A PC board holder 7 and a brake control assembly 8 are fastened in the top chamber between the partition board 6 and the upper shell 1 at locations below the music playing keys 11 and the control keys 12 respectively. The brake control assembly 8 divides the top chamber into a left-sided space for holding the sliding boxes 41, 42, and a right-sided space for holding the pencil sharpener 3, the sliding box 43 and the pencil holder 5. The PC board holder 7 has a music IC fastened therein, which music IC will produce any of a variety of sounds once either music playing key 11 is pressed. The brake control assembly 8 comprises six brake members 81 controlled to automatically respectively push the sliding boxes 41, 42, 43, 44, the pencil sharpener 3 and the sliding pencil holder 5 out of the pencil box, which brake members 81 are disposed right below the control keys 12. The brake members 81 are similar in structure, each of which having an elastic body 811, which constantly support a corresponding control key 12 in position, a hook 812 attached to said elastic body and hooked up with a hook 813 on either sliding box 41, 42, 43 or 44, the pencil sharpener 3 or the pencil holder 5, and a tension spring 9 respectively connected to either sliding box 41, 42, 43, 44 or the pencil sharpener 3 or the pencil holder 5. The tension spring 9 provides a spring force to automatically push out the sliding box 41, 42, 43 or 44, or the pencil sharpener 3 or the pencil holder 5, once a control key 12 is pressed down to release the hook 812 on either brake member 81 from the hook 813 on either sliding box 41, 42, 43 or 44, or the pencil sharpener 3 or the pencil holder 5 (see FIG. 4).

As indicated, when either music playing key 11 is pressed on, a corresponding sound will be produced. Further, either sliding box 41, 42, 43 or 44, or the pencil sharpener 3, or the pencil holder 5 can be automatically pushed to open simply by pressing a corresponding control key 12 on the upper shell 1.

What is claimed is:

1. A pencil box comprising a housing made in the shape of a mobile telephone, said housing being consisted of an upper shell and a bottom shell separated by a transverse partition board, said upper shell having a plurality of music playing keys and six control keys, said transverse partition board being to divide said housing into an upper chamber and a bottom chamber, a first sliding box fastened in said bottom chamber at one side for holding pencils, a PC board holder fastened in said upper chamber right below said music playing keys, said PC board holder having a music IC mounted thereon, a brake control assembly fastened in said top chamber below said control keys, a second sliding box and a third sliding box fastened in said upper shell at one side, a movable pencil sharpener fastened in said upper chamber at the top, a fourth sliding box and a sliding pencil holder fastened in said upper chamber at an opposite side, and means to respectively secure said first, second, third and fourth sliding boxes and said sliding pencil holder and said pencil sharpener to said brake control assembly, and wherein pressing on either music playing key causes said music IC to produce a corresponding sound; pressing on either control key causes said first, second, third or fourth sliding box or said sliding pencil holder or said pencil sharpener to be automatically pushed out of said housing.

2. The pencil box of claim 1, wherein said brake control assembly is comprised of six brake members respectively aligned with said six control keys, said brake members each having an elastic body, a hook releasably hooked up with a hook on either of said sliding boxes, said pencil sharpener or said sliding pencil holder, and a tension spring connected to either of said sliding boxes, or said pencil sharpener or said sliding pencil holder.

* * * * *